US007036562B2

(12) United States Patent
Ayres et al.

(10) Patent No.: US 7,036,562 B2
(45) Date of Patent: May 2, 2006

(54) HEAT EXCHANGER WITH CORE AND SUPPORT STRUCTURE COUPLING FOR REDUCED THERMAL STRESS

(75) Inventors: Steven M. Ayres, Redondo Beach, CA (US); David Wilson Beddome, San Pedro, CA (US); Edward Yuhung Yeh, Rancho Palos Verdes, CA (US)

(73) Assignee: Honeywell International, Inc., Morristown, NJ (US)

( * ) Notice: Subject to any disclaimer, the term of this patent is extended or adjusted under 35 U.S.C. 154(b) by 547 days.

(21) Appl. No.: 10/083,038

(22) Filed: Feb. 26, 2002

(65) Prior Publication Data

US 2003/0159807 A1 Aug. 28, 2003

(51) Int. Cl.
*F28F 7/00* (2006.01)

(52) U.S. Cl. ..... 165/81; 165/82; 165/76; 165/67

(58) Field of Classification Search ..... 165/81, 165/82, 76, 78, 67, 166, 149, 10, 83, DIG. 51; 122/510; 248/59, 60; 60/39.511
See application file for complete search history.

(56) References Cited

U.S. PATENT DOCUMENTS 3,968,834 A * 7/1976 Mangus et al. ..... 165/82
3,996,997 A * 12/1976 Regan et al. ..... 165/8
4,134,449 A * 1/1979 La Haye et al. ..... 165/83
4,328,860 A * 5/1982 Hoffmuller ..... 165/81
4,511,106 A * 4/1985 Graves ..... 248/65
5,114,588 A * 5/1992 Greene ..... 210/634
6,119,766 A * 9/2000 Blomgren ..... 165/81
6,283,199 B1 * 9/2001 Nakamura et al. ..... 165/81
6,703,154 B1 * 3/2004 Gorbell et al. ..... 429/32

OTHER PUBLICATIONS

U.S. Appl. No. 09/652,949, filed Aug. 31, 2000, Yeh et al.
U.S. Appl. No. 09/864,581, filed May 24, 2001, Beddome et al.
U.S. Appl. No. 10/037,564, filed May 5, 2002, Beddome et al.
U.S. Appl. No. 10/068,765, filed Dec. 21, 2001, Beddome et al.

* cited by examiner

*Primary Examiner*—Tho V Duong
(74) *Attorney, Agent, or Firm*—Chris James

(57) ABSTRACT

A heat exchanger with a core, a support structure and a mount. The core is variable in size and has a lower temperature fluid port and a higher temperature fluid port. The mount is positioned between the core and the support structure, adjacent to the higher temperature fluid port. The mount restrains the core relative to the support structure, such that when the core varies in size it does so either away from or towards the mount. The heat exchanger can also include a deformable connector, including a bellows, a flexible hose and a braided metal hose. The deformable connector is positioned in a manner which allows it and lower temperature fluid port to remain in fluid communication as the core varies in size.

5 Claims, 13 Drawing Sheets

HEAT EXCHANGER WITH CORE AND SUPPORT STRUCTURE COUPLING FOR REDUCED THERMAL STRESS

BACKGROUND

To improve the overall efficiency of a gas turbine engine, a heat exchanger or recuperator can be used to provide heated air for the turbine intake. The heat exchanger operates to transfer heat from the hot exhaust of the turbine engine to the compressed air being drawn into the turbine. As such, the turbine saves fuel it would otherwise expend raising the temperature of the intake air to the combustion temperature.

The heat of the exhaust is transferred by ducting the hot exhaust gases past the cooler intake air. Typically, the exhaust gas and the intake air ducting share multiple common walls, or other structures, which allow the heat to transfer between the two gases (or fluids depending on the specific application). That is, as the exhaust gases pass through the ducts, they heat the common walls, which in turn heat the intake air passing on the other side of the walls. Generally, the greater the surface areas of the common walls, the more heat which will transfer between the exhaust and the intake air. Also, the more heat which is transferred between the exhaust and the air, the greater the efficiency of the heat exchanger.

As shown in the cross-sectional view of FIG. 1*a* (FIG. 1*a*), one example of this type of device is a heat exchanger 5, which uses a shell 10 to contain and direct the exhaust gases, and a core 20, placed within the shell 10, to contain and direct the intake air. As can be seen, the core 20 is constructed of a stack 26 of thin plates 22 which alternatively channel the inlet air and the exhaust gases through the core 20. That is, the layers 24 of the core 20 alternate between channeling the inlet air and channeling the exhaust gases. In so doing, the ducting keeps the air and exhaust gases from mixing with one another. Generally, to maximize the total heat transfer surface area of the core 20, many closely spaced plates 22 are used to define a multitude of layers 24. Further, each plate 22 is very thin and made of a material with good mechanical and heat conducting properties. Keeping the plates 22 thin assists in the heat transfer between the hot exhaust gases and the colder inlet air.

Typically, during construction of such a heat exchanger 5, the plates 22 are positioned on top of one another and then compressed to form the stack 26. Since the plates 22 can separate if not held together, the compression of the plates 22 ensures that there are always positive compressive forces on the core 20 to hold the plates 22 in place.

Applying a high pre-load to the stack 26 reduces the potential for separation of the plates 22. However, to be able to apply pre-loads to the stack 26, a pre-load assembly or support structure 50 positioned about the stack 26, is needed. In addition to applying the pre-load to the stack 26, the support structure 50 carries any additional loading exerted by the stack 26. Such additional loads can come from a variety of sources, including thermal expansion of the stack 26 and the pressurization of air (or other medium) in the stack 26.

The support structure 50 collectively includes strongbacks 40, tie rods 30, and the shell 10. The tie rods 30 are held to the strongbacks 40 by fasteners 36 positioned at the ends 32 of the tie rods 30. Because the support structure 50 supports the core 20 (namely the stack 26) and is not a heat transfer medium, the components of the support structure 50 are made of much thicker materials than those of the core 20. Unfortunately, these thicker materials cause the support structure 50 to thermally expand at a much slower rate than the quick responding core 20, with its thin plates 22. The thickness (and thus the thermal response) of the support structure 50 will also be affected by the amount of the pre-load applied to the core 20.

Differential expansion or contraction between the core 20 and the support structure 50 can result from a variety of sources, including differential thermal expansion rates and air (or fluid) pressure variations. Differential expansion or contraction between elements of the heat exchanger 5 can occur in any dimension, and typically in all dimensions at the same time. That is, not only will the core 20 expand or contract along its length, $L_{A1}$, quicker than the support structure 50 will, but it also deforms faster along its width, $W_{A1}$, and depth (not show).

As can be seen in FIG. 1*a*, to bring air into the core 20, an air inlet tube 23 is positioned within an inlet manifold 25. Likewise, an air outlet tube 29 is positioned within an outlet manifold 27. However, as the core 20 expands, or contracts, along its width (and depth) faster than that of the support structure 50, the inlet manifold 25 and outlet manifold 27 will move, as shown in FIG. 1*b* (FIG. 1*b*) (showing the core 20 differentially expanded). With the core 20 expanded (to a width of $W_{A2}$), the inlet manifold 25 and the outlet manifold 27 are no longer aligned with the respective openings of support structure 50. The misalignment of the manifolds places stresses on the tubes 23 and 29, and may result in the tubes being deformed (as shown), displaced and/or otherwise damaged. Movement of the tubes 23 and 29 may cause them to contact and damage the interior portions of the core 20. Damage to the core 20 and the tubes 23 and 25 can be costly and time consuming to correct. Further, deformation of the tubes 23 and 25, can result in a disruption and a reduction of the airflow through the core 20, which in turn, can lower the efficiency of the heat exchanger 5. Also, a reduction of the air passing through the core 20, may cause severe damage to the core 20 due to overheating.

Approaches to preventing damage from lateral expansion of the core 20 have included attempts to restrain the expansion and/or contraction of the core by application of additional compressive forces. However, such expansion/contraction restraining has resulted in the core and the support structure being put under excessive loading. This loading can result in high stresses and thermal damage or failure to both the core and the support structure. Such thermal damage includes creep and/or buckling of the associated structures.

While the structures of the heat exchanger can be enlarged to carry greater loads, doing so results in certain disadvantages. These disadvantages include: a lowering of the heat transfer characteristics of the core, an increase in the differential expansion/contraction between the core and the support structure, and an increase in the cost and weight of the heat exchanger.

One approach to accommodate the width-wise differential thermal expansion and contraction has been to use an inlet bellows 60 and an outlet bellows 70, as shown in FIG. 2 (FIG. 2). The inlet bellows 60 and the outlet bellows 70 are used to keep the inlet tube 23 connected to an external inlet duct and the outlet tube 29 connected to an external outlet duct as the core 20 moves relative to the support structure 50. As the core 20 expands in width, the inlet bellows 60 and the outlet bellows 70 both deform to maintain pathways for the flow of air.

This prevents stresses from being placed on the tubes 23 and 29, as well as on the core 20.

One problem with the use of the bellows is that the outlet bellows 70 is very expensive and difficult to manufacture. This is because the outlet bellows 70 must be able function under the extreme temperatures associated with the outlet side of the core 20. Typically, these temperatures are very close to, or the same as, the temperature of exhaust gases, which enter the core 20 just after exiting from the attached turbine engine (not shown). Materials which can withstand these temperatures and continue to be sufficiently flexible over time are very expensive and difficult to use in fabricating the outlet bellows 70.

An additional problem with using a bellows system such as that shown in FIG. 2, is that with repeated thermal cycling, the core 20 can migrate about relative to the support structure 50. This can result in restrictions in the airflow, damage to the bellows, and/or failure of one or both of the bellows. Also, such core movement requires that the length of the bellows be increased, which in turn increases the cost of the heat exchanger.

Therefore, a need exists for a heat exchanger which accommodates differential expansion or contraction between the core and the supporting structure, such that the airflow through the core is not significantly disrupted. The heat exchanger must be configured to prevent failures or damage caused by buckling, creep or any other similar source. Further, the heat exchanger should be relatively simple in construction and operation to minimize its cost, weight and complexity.

SUMMARY

The present invention provides a heat exchanger which in at least some embodiments includes a core, a support structure and a mount. The core is variable in its size and has a first port and a second port. The mount is positioned between the core and the support structure, adjacent to the second port of the core. The mount restrains the core relative to the support structure, such that when the core varies in size it does so either away from or towards the mount.

The heat exchanger can also include a deformable or flexible connector (e.g. bellows). This connector is attached to the core in a manner which allows it and the first port of the core to remain in fluid communication as the core varies in size. In this manner, the heat exchanger can remain attached to a substantially fixed structure (e.g. external ducting), while the core expands and contracts. The connector can be a bellows, a flexible high temperature hose or the like.

The mount includes a pin and a receiver. The receiver receives the pin so as to restrain the movement of the core. The arrangement of the mount varies by embodiments of the invention. For example, the pin can be attached to the support structure and the receiver is defined in the core. Another embodiment has the pin attached to the core and receiver is defined in the support structure. In yet another embodiment, the mount has a core receiver, a support structure receiver and a pin. In turn, the pin has a first end and an opposing second end, with the core receiver receiving the first end and the support structure receiver receiving the second end. The core receiver is defined in the core and the support structure receiver is defined in the support structure.

In some embodiments of the present invention, a lower temperature fluid (e.g. air) passes through the first port of the core and a higher-temperature fluid (e.g. air) passes through the second port of the core. In this manner, the connector carries a lower temperature fluid and the mount is positioned adjacent the second port, which channels a high temperature fluid. As such, the connector needs only to be fabricated to carry lower temperature fluids and a minimum amount of core expansion will occur at the second port. The connector can be flexible to accommodate the expansion and contraction of the core and remain in fluid communication with the first port and any attached external fluid transport means (e.g. ducting).

In other embodiments, the heat exchanger includes a laterally expandable core, a support structure, a mount and a bellows. Being expandable, the core is variable in its size. The core has a lower temperature fluid port and a higher temperature fluid port. The mount is positioned between the core and the support structure, adjacent the higher temperature fluid port. The mount functions to restrain the core, such that the core varies in size laterally away from and towards the mount. The bellows is attached at the lower temperature fluid port. This is done so that the bellows, the lower temperature fluid port and any external ducting (e.g. tube), are in constant fluid communication as the core varies in size.

DETAILED DESCRIPTION

Figure 1A:
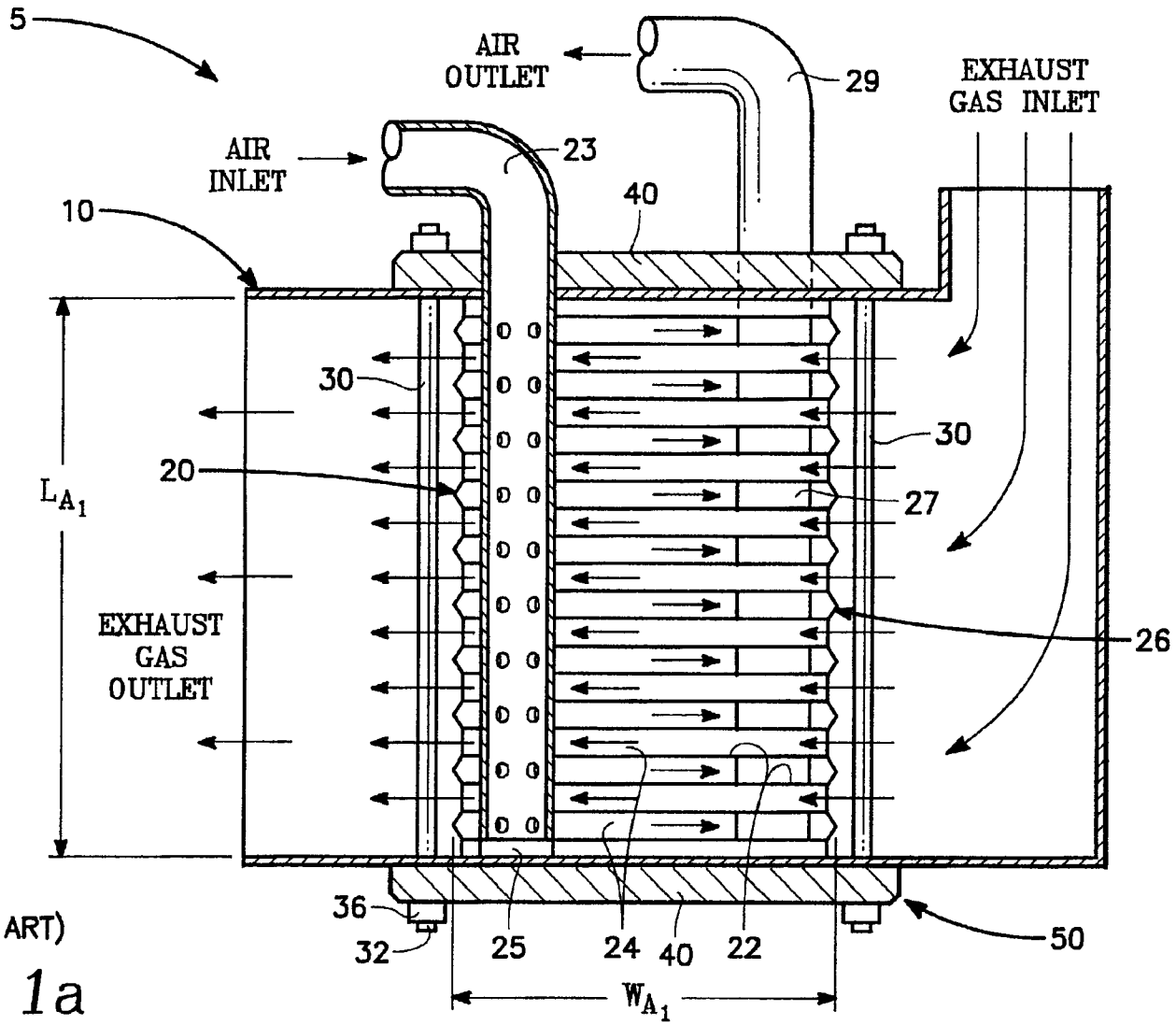
(PRIOR ART) Fig. 1a
FIGS. 1*a* and *b* are perspective views of cross-sections of a heat exchanger and a portion of a heat exchanger.
Figure 1B:
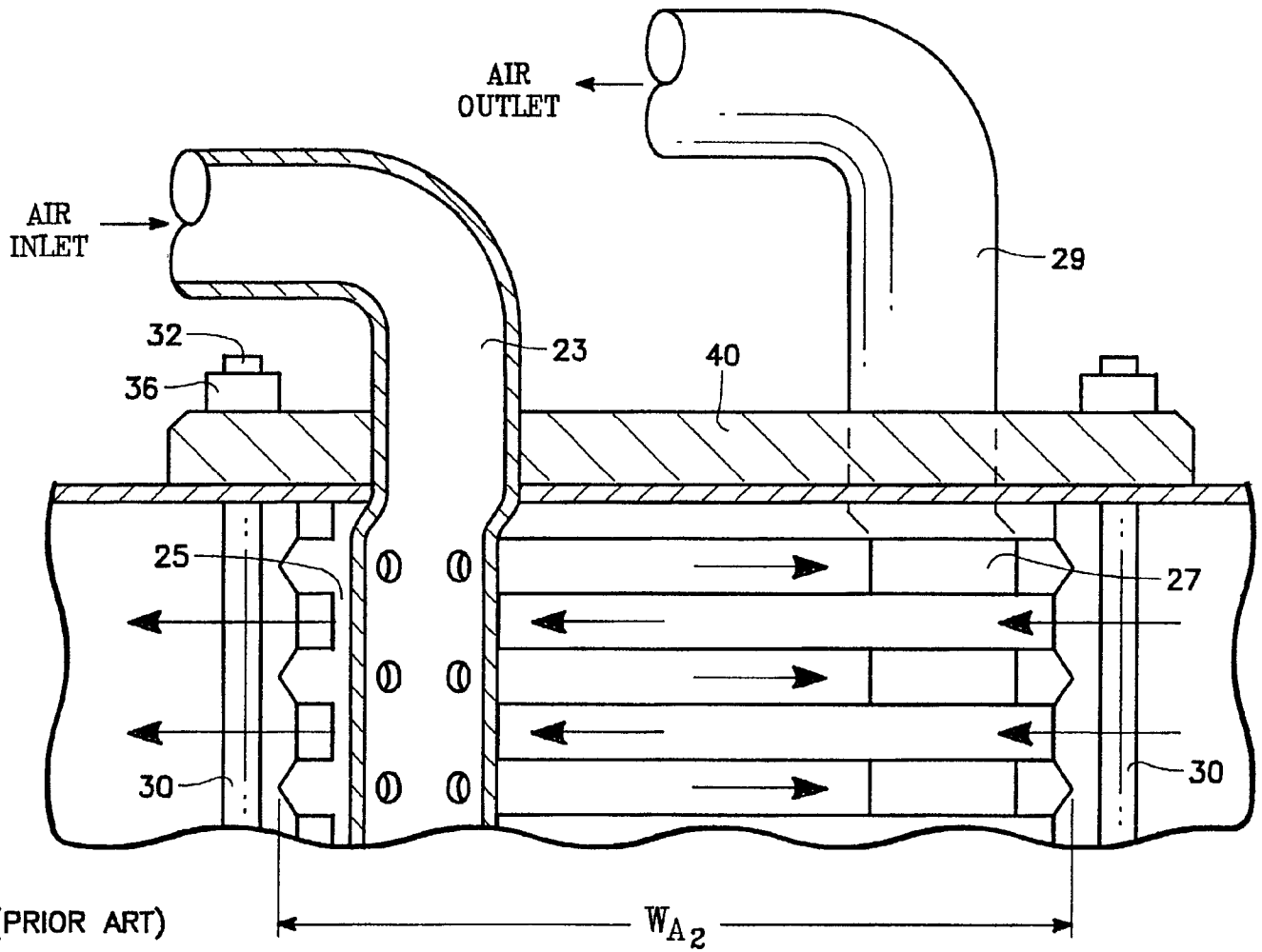
(PRIOR ART) Fig. 1b
Figure 2:
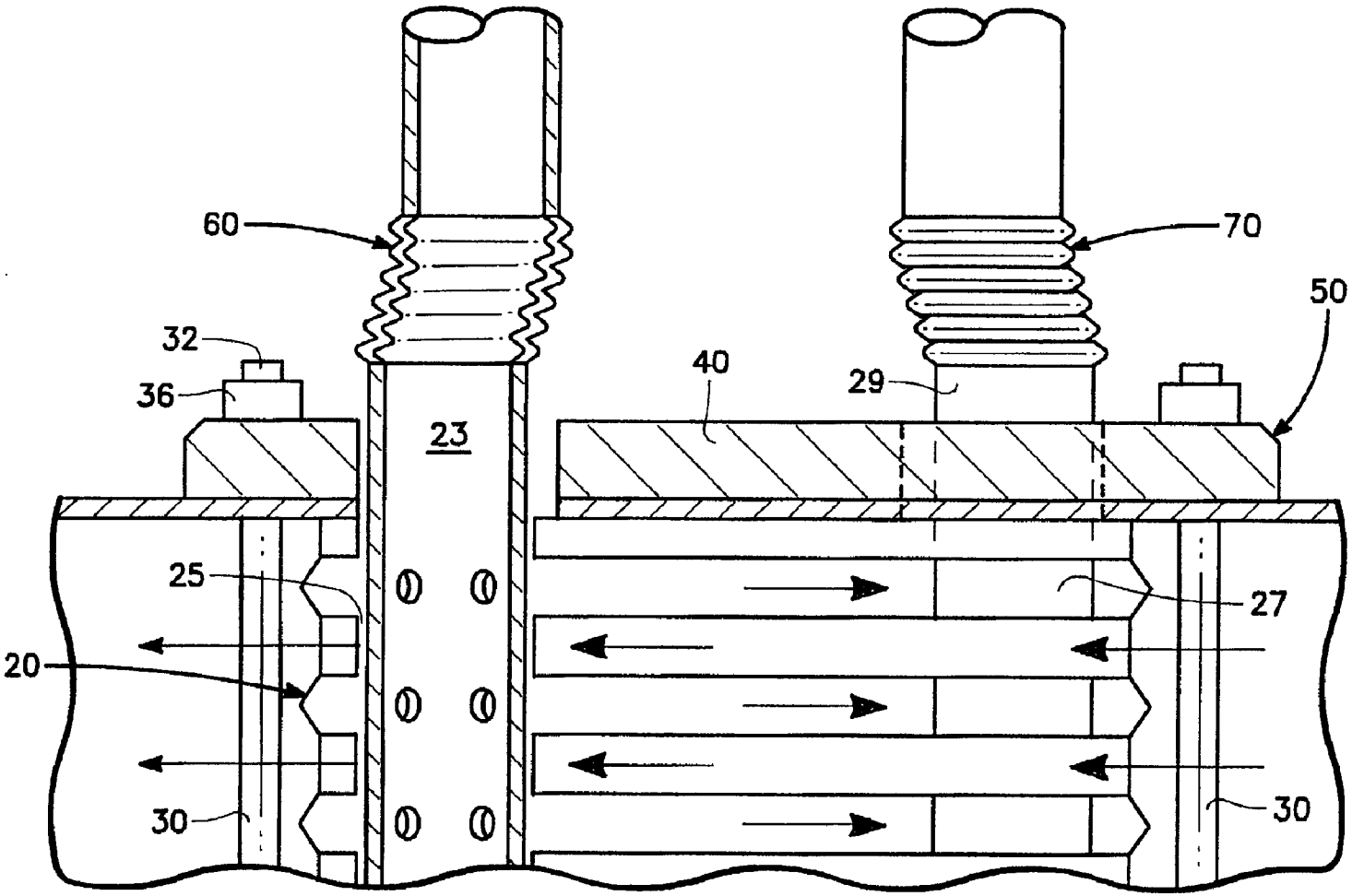
(PRIOR ART) Fig. 2
FIG. 2 is a perspective view of a cross-section of a heat exchanger.

The present invention is embodied in an apparatus which provides several advantages over prior devices. One such advantage is that the invention allows differential expansion or contraction between the core and the support structure without structural damage. Another advantage is that the airflow to, or from, the core is kept substantially unrestricted during the expansion and contraction of the core.

In at least some embodiments of the invention, the core is secured to the support structure at a single location and is allowed to expand out from the location and contract in towards it. It is preferred that the securing location is set near (e.g. adjacent) the core's higher temperature fluid port. The core can be secured to the support structure by a pin and receiver apparatus. A flexible connector is used to maintain fluid flow through the core during the core's expansion and contraction. It is preferred that this connector (e.g. bellows, flexible hose, etc.) is positioned at the core's lower temperature fluid port. This allows the connector to be designed and fabricated to transport only lower temperature fluids, reducing cost and complexity of the connector.

With the core held in place near the higher temperature fluid port, the rest of the core is free to expand and contract. As such, the lower temperature fluid port and the flexible connector move with the expansion and contraction of the core. While the flexible connector moves, it functions to maintains a substantially unrestricted fluid passage way between the core and any external structure (e.g. ducting) attached thereto.

Another advantage of the present invention is that, by allowing relatively free differential expansion and contraction of the core, it prevents damage which would otherwise occur by restricting the movement of the structures. This damage potentially would occur from a variety of sources including buckling, fatigue, creep or the like. Preventing such damage results in an increased life span of the heat exchanger and reduces the amount of supporting structure needed.

Still another advantage of the present invention is that the overall cost and complexity of the heat exchanger is reduced. This reduction is due to, among other things, the simplicity of construction, reduction in the structural elements and reduced material costs. For example, with the core secured at or near the core's higher temperature fluid port, a direct connection can be made from this port to any external structure (e.g. ducting), eliminating the need for a flexible connector at this location. Since a flexible connector at the higher temperature port must be able to withstand the extreme heat, while remaining sufficiently flexible, it must be made of relatively expensive materials. As such, the overall cost of the heat exchanger can be reduced. Further, eliminating this high temperature flexible output connector reduces the complexity of the heat exchanger, which in turn eases the assembly.

Heat exchanger apparatuses which provide for differential thermal expansion are set forth in U.S. patent application (Number to be assigned) filed on Feb. 5, 2002, entitled HEAT EXCHANGER HAVING VARIABLE THICKNESS TIE RODS AND METHODS OF FABRICATION THEREOF, by David Beddome, Steve Ayres and Yuhung Edward Yeh, which is hereby incorporated by reference in its entirety, U.S. patent application (Number to be assigned), filed Dec. 21, 2001, entitled HEAT EXCHANGER WITH BIASED AND EXPANDABLE CORE SUPPORT STRUCTURE, by David Beddome, Steve Ayres and Yuhung Edward Yeh, which is hereby incorporated by reference in its entirety, U.S. patent application Ser. No. 09/652,949, filed on Aug. 31, 2000, entitled HEAT EXCHANGER WITH BYPASS SEAL ALLOWING DIFFERENTIAL THERMAL EXPANSION, by Yuhung Edward Yeh, Steve Ayres and David Beddome, which is hereby incorporated by reference in its entirety, and U.S. patent application Ser. No. 09/864,581, filed on May 24, 2001, entitled HEAT EXCHANGER WITH MANIFOLD TUBES FOR STIFFENING AND LOAD BEARING, by David W. Beddome, Steve Ayres, Yuhung Edward Yeh, Ahmed Hammoud, David Bridgnell and Brian Comiskey, which is hereby incorporated by reference in its entirety.

Figure 3A:
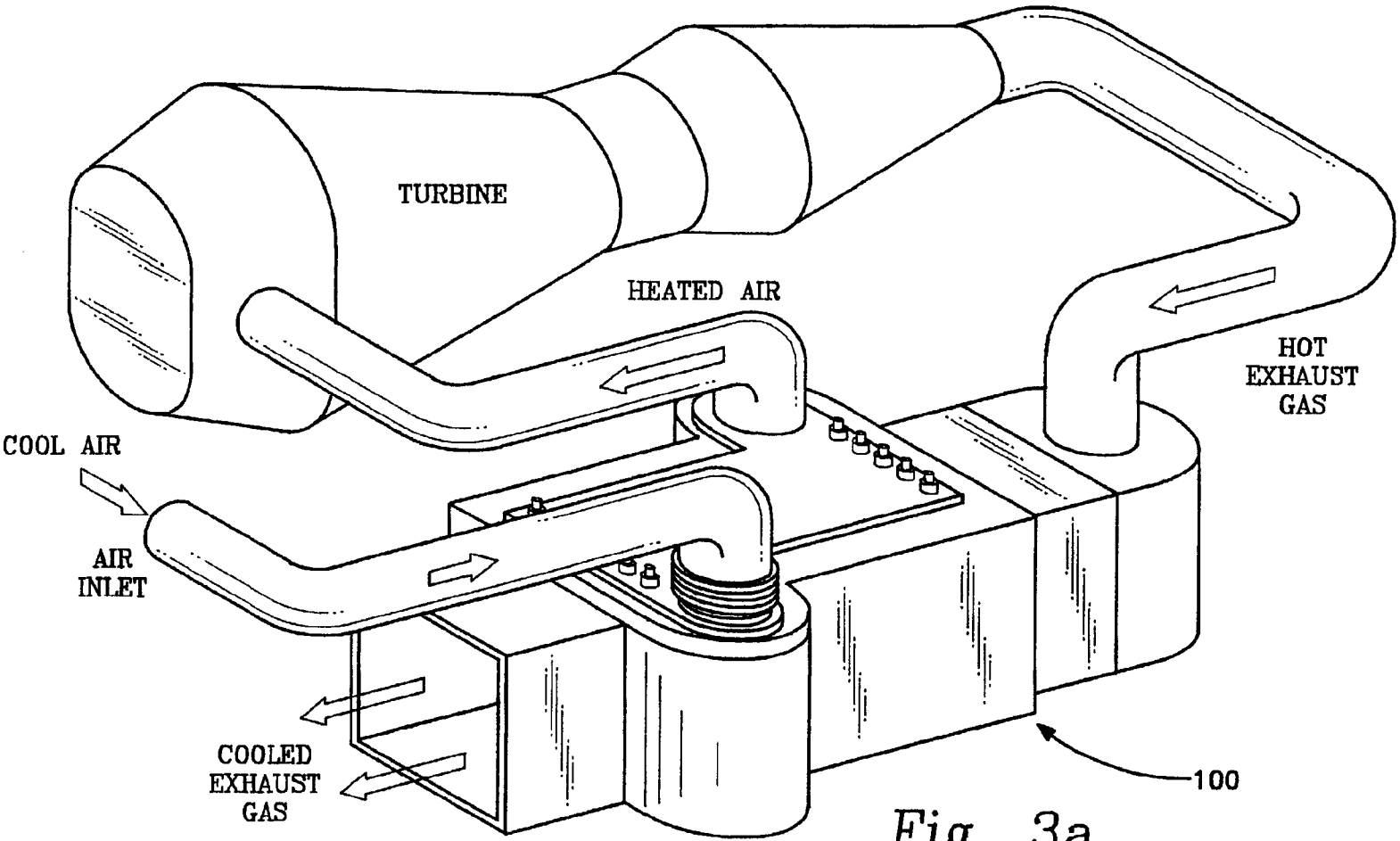
FIGS. 3*a* and *b* are isometric views of a turbine/heat exchanger system in accordance with the present invention.

As shown in FIG. 3*a* (FIG. 3*a*), for some embodiments, the present invention is a heat exchanger 100 which can be used in conjunction with a gas turbine engine. The heat exchanger 100 functions to heat the inlet fluid, in this case air, prior to it entering the turbine and cool the fluid exiting the turbine, in this case exhaust gases, prior to it exiting the heat exchanger 100. This is achieved by directing the inlet air so that it passes adjacent to the exhaust gas, such that heat is transferred from the exhaust to the inlet air. Specifically, as set forth in FIG. 3*a*, air enters at an air inlet and is directed through the heat exchanger 100 where it is heated by heat from the exhaust gases. Then, the heated air is directed from the heat exchanger 100 to the turbine. The turbine uses the air to operate and in so doing expels the exhaust gas. The exhaust gas is directed into and through the heat exchanger 100 where it heats the inlet air. The cooled exhaust gas then exits from the heat exchanger 100. A detailed description of the functioning and structure of the heat exchanger 100 is set forth herein.

While FIG. 3*a* shows an example of a system in that some embodiments of the present invention are used, many other systems and uses are possible, including the use of engines other than a gas turbine, and fluids other than air and exhaust gases. In some embodiments of the present invention (as detailed below), the heat exchanger intakes a higher temperature fluid at its inlet and outputs a lower temperature fluid at its outlet.

Figure 3B:
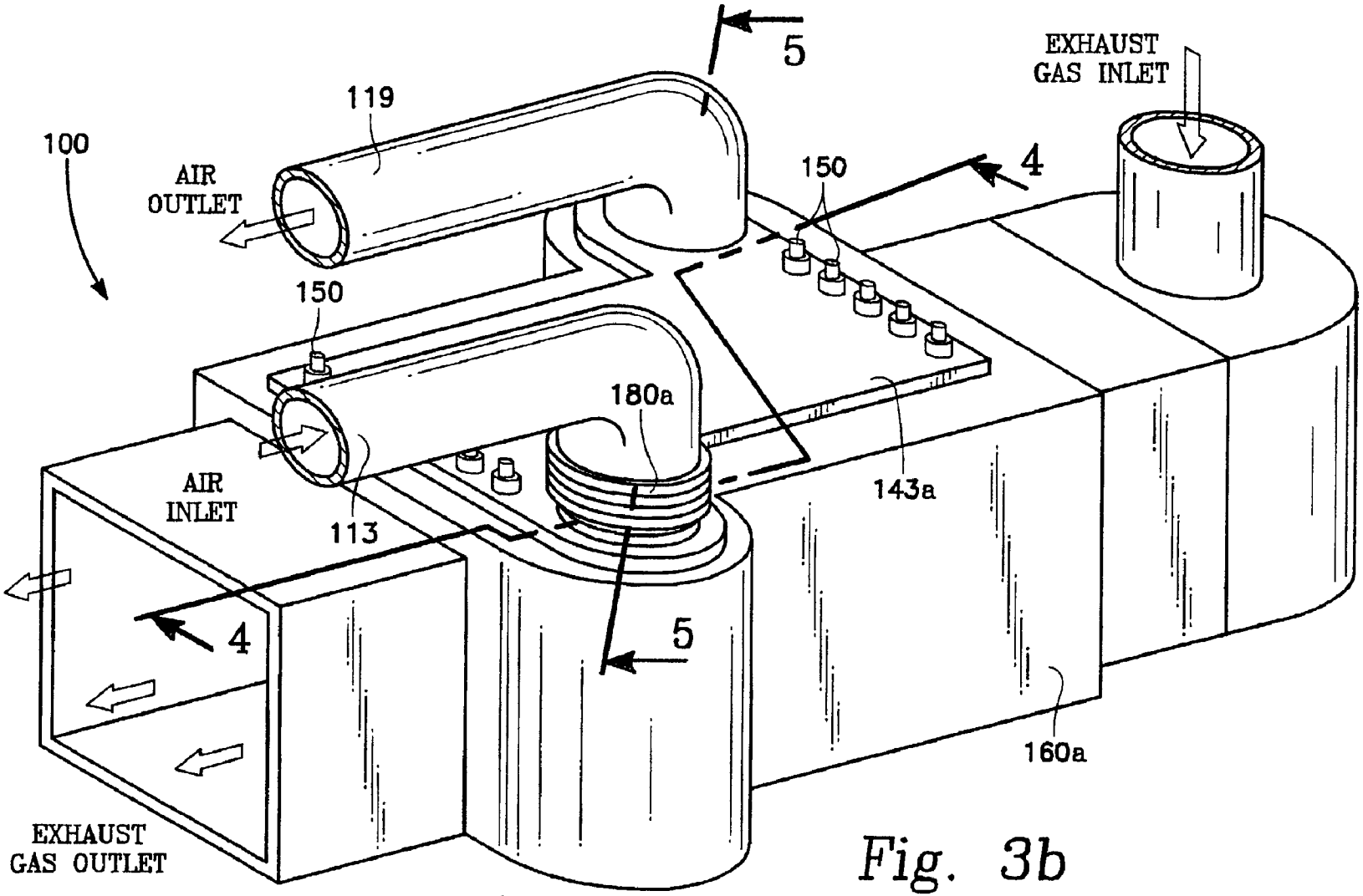

FIG. 3*b* (FIG. 3*b*) shows an embodiment of the heat exchanger 100 with an lower temperature fluid duct or air inlet 113 and a higher temperature fluid duct or air outlet 119, to bring air into and out of a heat transfer core (not shown), and an exhaust gas inlet and an exhaust gas outlet, to direct the exhaust gases through the heat exchanger 100. The heat exchanger 100 also has a shell assembly 160*a* with a first or upper strongback 143*a* and a second or lower strongback 145 (not shown) on either end. Connecting the strongbacks are a set of tie rods 150. Set between the air inlet and the core is a flexible connector 180*a*. FIG. 3*b* sets forth the cross-sections of the heat exchanger 100 as shown in FIG. 4 (FIG. 4) and FIG. 5 (FIG. 5).

Figure 4:
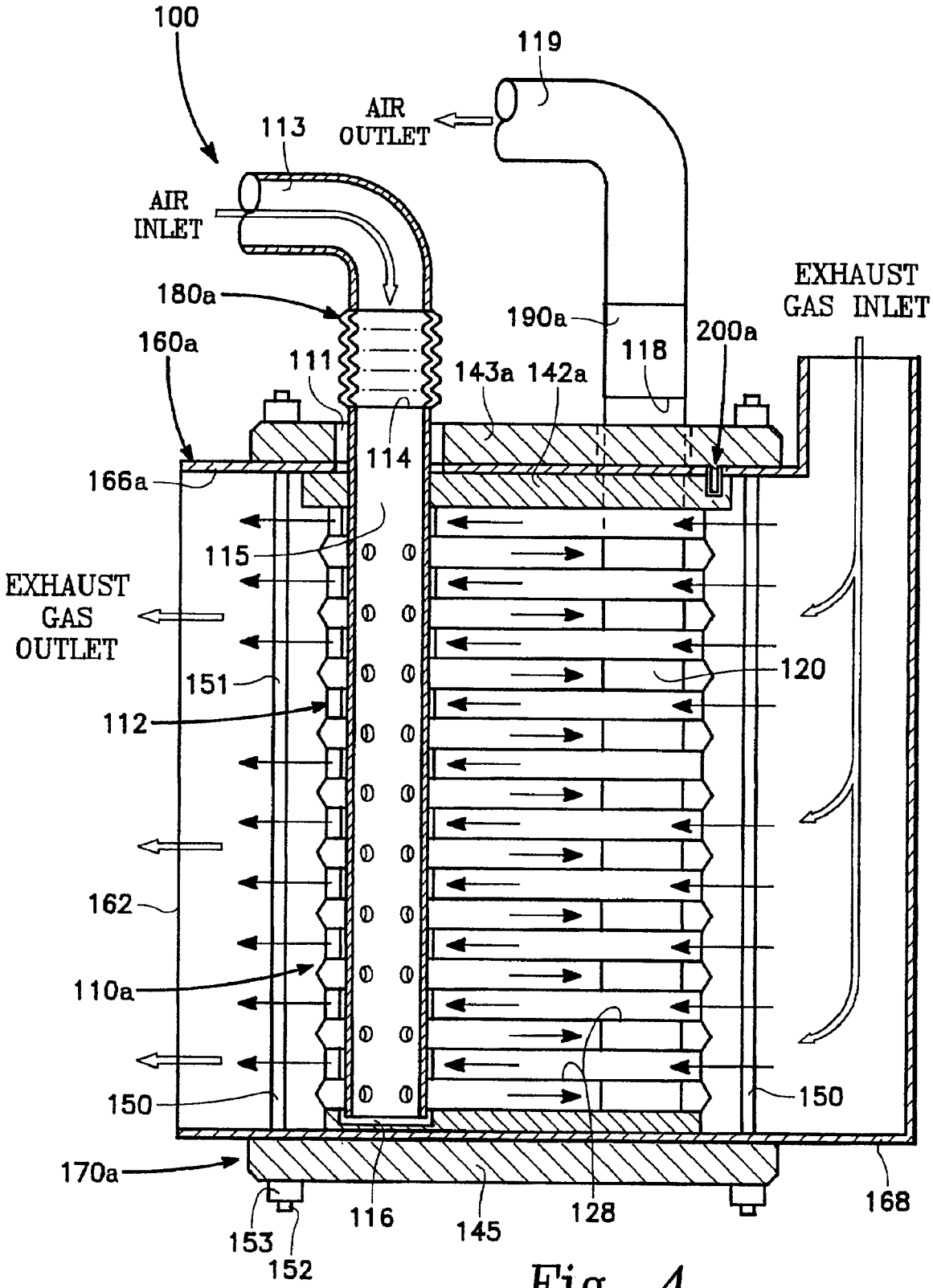
FIG. 4 is a perspective view of a cross-section of a portion of a heat exchanger in accordance with the present invention.
Figure 5:
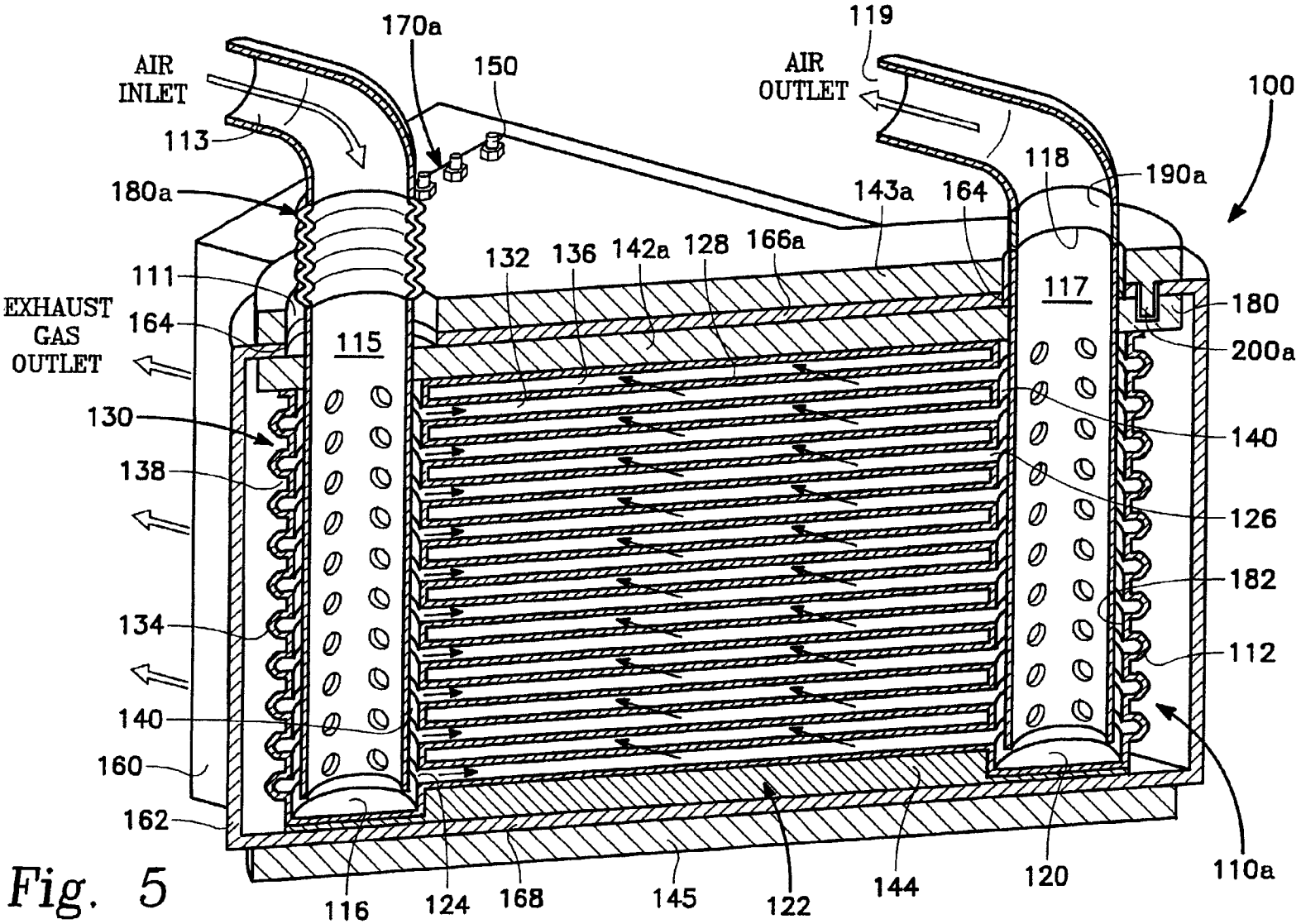
FIG. 5 is an angled cross-section of a portion of a heat exchanger in accordance with the present invention.

For some embodiments of the present invention, as shown in the cut-away views of FIGS. 4 and 5, the heat exchanger 100, has a core 110*a* positioned within the shell assembly 160*a*. Outside the shell 160*a* are the upper strongback 143*a* and the lower strongback 145, connected by the tie rods 150. The upper strongback 143*a*, the lower strongback 145, the tie rods 150, and the shell 160*a*, collectively form a support structure 170*a*. Positioned between the core 110*a* and the support structure 170*a* is a mount 200*a*. The flexible connector or bellows 180*a* is positioned between the air inlet 113 and a lower temperature fluid manifold tube or inlet manifold tube 115.

The core 110*a* is positioned within the shell 160*a*. The core 110*a* functions to duct the inlet air pass the exhaust gas, so that the heat of the exhaust gas can be transferred to the cooler inlet air. The core 110*a* performs this function while keeping the inlet air separated from the exhaust gas, such that there is no mixing of the air and the gas. By moving air near the gas without mixing the two, the heat exchanger 100 transfers heat at a high level of efficiency. Further, the heat exchanger 100 also maximizes engine performance by not allowing the exhaust gases to be introduced into the intake air of the turbine (or other engine).

As shown in FIGS. 4 and 5, the core 110*a* has an exterior surface 112. A lower temperature fluid port, an air inlet port or first port 114 brings air into the core 110*a* and a higher temperature fluid port, air outlet port or second port 118 brings air out of the core 110*a*. The air inlet port 114 receives relatively cool inlet air for passage through the core 110*a*. When the heat exchanger 100 is operating, the air exiting the air outlet port 118, having been heated in the core 110*a*, will have a much higher temperature than the inlet air. Between the air inlet port 114 and the air outlet port 118 are the inlet manifold tube 115, a lower temperature fluid manifold or inlet manifold 116, a heat exchange region 122, a higher temperature fluid manifold or outlet manifold tube 117, and a higher temperature fluid manifold or outlet manifold 120.

While the heat exchanger 100 is operating, the core 110*a* has a variable size (e.g. length and width) caused by thermal expansion or contraction. That is, as the core 110*a* is heated up by the exhaust gases passing through the shell, the core 110*a* will expand and as the heat exchanger 100 stops operating the core 110*a* will contract as it cools.

The heat exchange region 122 can be any of a variety of configurations that allow heat to transfer from the exhaust gas to the inlet air, while keeping the gases separate. However, it is preferred that the heat exchange region 122 is a prime surface heat exchanger having a series of layered plates 128, which form a stack 130. The plates 128 are arranged to define heat exchange members or layers 132 and 136 which alternate from ducting air, in the air layers 132, to ducting exhaust gases, in the exhaust layers 136. These layers typically alternate in the core 110*a* (e.g. air layer 132, gas layer 136, air layer 132, gas layer 136, etc.). Separating each layer 132 and 136 is a plate 128.

On either end of the stack 130 are a first end plate 142*a* and a second end plate 144. The first end plate 142*a* is positioned against the upper portion of the shell assembly 160*a* and the second end plate 144 is positioned against the lower portion of the shell assembly 160*a*.

Also shown in FIG. 4, are the ties rods 150 positioned on either side of the core 110*a*. A series of the tie rods 150 and an upper strongback or load bearing member 143*a* and a lower strongback or load bearing member 145, are used to hold the stack 130 together and carry loads. The tie rods 150 function to apply a compressive load to the strongbacks 143*a* and 145. The tie rods 150 include a center section 151 running between either end 152 and fasteners 153 at each end 152. The fasteners 153 function to hold the tie rods 150 to the strongbacks 143*a* and 145. The tie rods 150 can be made of any suitable well known material including, but not limited to, steel and aluminum. However, the tie rods 150 are preferably stainless steel. The tie rods 150 are described in further detail below.

On the outside of the shell 160*a* and above and below the core 110*a*, are the upper strongback 143*a* and the lower strongback 145. The tie rods 150 and the strongbacks 143*a* and 145 (as well as the shell 160) carry compressive loads applied to the stack 130. These compressive loads can be from a variety of sources including pre-loading, differential thermal expansion, air pressure, and the like.

The upper strongback 143*a*, the lower strongback 145, the tie rods 150, and the shell 160*a*, together form the support structure 170*a*. The support structure 170*a* functions to apply the compressive force to the stack 130 of the core 110*a*. In contrast to the tie rods 150, the upper strongback 143*a* and the lower strongback 145 are generally not deformable.

As can be seen, the plates 128 are generally aligned with the flow of the exhaust gas through the shell assembly 160*a*. The plates 128 can be made of any well known suitable material, such as steel, stainless steel or aluminum, with the specific material dependent on the operating temperatures and conditions of the particular use. The plates 128 are stacked and connected (e.g. welded or brazed) together in an arrangement such that the air layers 132 are closed at their ends 134. With the air layers 132 closed at ends 134, the core 110*a* retains the air as it passes through the core 110*a*. The air layers 132 are, however, open at air layer intakes 124 and air layer outputs 126. As shown in FIGS. 5 and 6, the air layer intakes 124 are in communication with the inlet manifold 116, so that air can flow from the inlet manifold tube 115 through the inlet manifold 116 and into each air layer 132. Likewise, the air layer outputs 126 are in communication with the outlet manifold 120, to allow heated air to flow from the air layers 132 through the outlet manifold 120 and out the outlet manifold tube 117.

In contrast to the air layers 132, the gas layers 136 of the stack 130 are open on each end 138 to allow exhaust gases to flow through the core 110*a*. Further, the gas layers 136 have closed or sealed regions 140 located where the layers 136 meet both the inlet manifold 116 and the outlet manifold 120. These closed regions 140 prevent air, from either the inlet manifold 116 or the outlet manifold 120, from leaking out of the core 110*a* into the gas layers 136. Also, the closed regions keep the exhaust gases from mixing with the air.

Therefore, as shown in FIGS. 4 and 5, the intake air is preferably brought into the core 110*a* via the inlet manifold 116 and distributed along the stack 130, passed through the series of air layer intakes 124 into the air layers 132, then sent through the air layers 132 (such that the air flows adjacent—separated by plates 128—to the flow of the exhaust gas in the gas layers 136), exited out of the air layer 132 at the air layer outputs 126 into the outlet manifold 120, and finally out of the core 110*a*. In so doing, as the air passes through the core 110*a*, it receives heat from the exhaust gas.

With the stack 130 arranged as shown in FIGS. 4 and 5, the hot exhaust gas passes through the core 110*a* at each of the gas layers 136. The exhaust gas heats the plates 128 positioned at the top and bottom of each gas layer 136. The heated plates 128 then, on their opposite sides, heat the air passing through the air layers 132.

As the plates 128 and the connected structure of the core 110*a* heat up, they expand. This results in an expansion of the entire stack 130 and thus of the core 110*a*. As noted in detail below, the inlet bellows 180*a* and the mount or restraining apparatus 200*a* are configured to allow the core 110*a* to thermally expand separately from the support structure 170*a*. In this manner, the core 110*a* can expand and contract laterally without the build-up of excessive forces between the core 110*a* and the support structure 170*a* and without the use of a bellows at the air outlet port 118 of the core 110*a*. This saves the core 110*a* from being damaged by forces which would otherwise be created by affixing the core 110*a* in place. Also, it reduces the cost of the heat exchanger 100 by eliminating the need for an expensive outlet bellows.

Although the core 110*a* can be arranged to allow the air to flow through it in any of a variety of ways, it is preferred that the air is channeled so that it generally flows in a direction opposite, or counter, to that of the flow of the exhaust gas in the gas layers 136 (as shown in the cross-section of FIG. 4). With the air flowing in an opposite direction to the direction of the flow of the exhaust gas, it has been found by the Applicants that the efficiency of the heat exchanger is significantly increased as compared to other flow configurations. As noted in detail below, some embodiments of the present invention have the core functioning to cool hot fluid entering the core inlet with a cooler fluid being direct through the shell.

The arrangement of the core 110*a* can be any of a variety of alternate configurations. For example, the air layers 132 and gas layers 136 do not have to be in alternating layers, instead they can be in any arrangement which allows for the exchange of heat between the two layers. For example, the air layers 132 can be defined by a series of tubes or ducts running between the inlet manifold 116 and the outlet manifold 120. While the gas layers 136 are defined by the space outside of, or about, these tubes or ducts.

To facilitate heat transfer, the core 110*a* can also include secondary surfaces such as fins or thin plates connected to the inlet air side of the plates 128 and/or to the exhaust gas side of the plates 128.

The core 110*a* and shell 160*a* can carry various gases, other than, or in addition to, those mentioned above. Also, the core 100*a* and shell 160*a* can carry any of a variety of fluids.

As shown in FIGS. 4 and 5, the shell assembly 160*a* includes side walls 162, openings 164, an upper panel 166*a* and a lower panel 168. The shell assembly 160*a* functions to receive the hot exhaust gases, channel them through the core 110*a*, and eventually direct them out of the shell 160*a*. The shell 160*a* is relatively air tight to prevent the exhaust gases from leaking out of the shell 160*a*. The shell 160*a* is large enough to fully contain the core 110*a* and at least strong enough to withstand the pressure exerted on the shell 160*a* by the exhaust gas. Typically, the shell 160*a* is flexible and can be deformed to varying amounts depending on its specific construction.

The openings 164 of shell 160*a* are positioned through the upper panel 166*a*. The shell assembly 160*a* can be made of any suitable well known material including, but not limited to, steel and aluminum. Preferably, the shell 160*a* is a stainless steel.

The construction of the shell assembly 160*a* can vary depending on the particular embodiment of the present invention. In some embodiments the shell 160*a* is constructed to carry some of the compressive load generated by the support structure 170*a* and applied to the core 110*a*. The shell 160*a* can also be configured to carry other internally created loads (e.g. air pressure loads) and externally exerted loads (e.g. inertia loads or vibration loads). Because in some embodiments of the present invention, the walls 162, upper panel 166*a* and lower panel 168 of the shell 160*a* are thick relative to the thin core plates 128, the shell 160*a* will thermally expand at a slower rate than the core 110*a*. This can result in differential thermal expansion or contraction between the shell 160*a* and the core 110*a*, as the two are either heated or cooled, as the case may be. To avoid, or to minimize, gaps or spaces forming between the core 110*a* and the shell 160*a* during differential expansion, the shell 160*a* is flexible enough to be deformed by the forces applied by the strongbacks 143*a* and 145 and the tie rods 150.

In other embodiments, the structure of the shell 160*a* is relatively thin. In such embodiments, the compressive loads created by the support structure 170*a* are primarily carried by the strongbacks 143*a* and 145 and the tie rods 150. In such embodiments, because the shell 160*a* is thinner, the shell 160*a*, thermally expands and contracts much quicker. This allows any differential thermal expansion between the shell 160*a* and the core 110*a* to be minimized. Which, in turn, aids in preventing gaps from forming between the core 110*a* and the shell 160*a*. This thinner structure also increases the shell's flexibility and allows the shell 160*a* to be more easily deformed by the strongbacks 143*a* and 145 and the tie rods 150. As such, in these embodiments, the potential for exhaust gases being able to pass around the core 110*a*, through gaps between the core 110*a* and the shell 160*a*, is further reduced.

The present invention, however, provides for differential thermal expansion between the structures of the heat exchanger 100 by employing the inlet bellows 180*a* and the mount 200*a* to allow the core 110*a* to thermally expand separately from the support structure 170*a*, while maintaining a substantially unrestricted airflow through the core 110*a*. As shown herein, a variety of embodiments of the support structure and tie rods exist.

As shown in FIGS. 4 and 5, one embodiment of the present invention has the core 110*a* fixed to the support structure 170*a* near the air outlet port 118 and movable near the air inlet port 114. This embodiment allows the core 110*a* to expand and contract freely in a lateral direction, while preventing damage to components of the heat exchanger 100 and while maintaining a sealed and unobstructed flow of air through the core 110*a*.

This embodiment is achieved by using the deformable connector, flexible bellows or hose 180*a* positioned between the air inlet port 114 and any external air ducting (e.g. the air inlet). A direct, substantially rigid or fixed outlet connector 190*a* is set between the air outlet port 118 and any external ducting (e.g. the air outlet).

With the core 110*a* fixed in place by the mount 200*a* near air outlet port 118 and the outlet connector 190*a*, the core 110*a* will have little or no movement at the outlet connector 190*a* during the differential thermal expansion or contraction of the core 110*a*. All the lateral expansion and contraction of the core 110*a* occurs out away from the mount 200*a*, and thus, out from the connector 190*a* (being positioned in close proximity to the mount 200*a*).

As such, the outlet connector 190*a* can be fixed and does not have to deform (at least not in any significant manner) to accommodate the differential expansion or contraction of the core 110*a*. That is, as shown in FIGS. 4 and 5, the outlet connector 190*a* is a straight section extending between the air outlet port 118 and the air outlet duct. The connector 190*a* can be any of a variety of shapes and/or lengths, however it is preferred that the connector 190*a* is shaped to match the shapes of the outlet 118 and the outlet manifold 120. Specifically, it is preferred that the connector 190*a* is a tube with a round cross-section. The connector 190*a* is preferably stainless steel, but other materials including steel and aluminum can be used.

It should be noted that since the mount 200*a* is slightly offset from the connector 190*a* that in some embodiments of the present invention the connector 190*a* may be subject to some relatively minor lateral deformation. It is preferred that the connector 190*a* be sufficiently laterally deformable to accept any such differential expansion. As such, a bellows is not needed between the air outlet port 118 the air outlet duct.

By not needing to use an outlet bellows, the present invention reduces the cost and complexity of the heat exchanger 100. A bellows set between the manifold 120 and the outlet 118 would have to remain sufficiently flexible at the higher temperatures found at the core's outlet. Such bellows are significantly more expensive and complex than a straight connector, such as the outlet connector 190*a*.

Of course, because the air inlet port 114 is positioned much further away from the mount 200*a* than the air outlet port 118, the lateral movement of the core 110*a* is much greater at the air inlet port 114 than at the air outlet port 118. To maintain a sealed and generally clear path for the inlet air, the inlet bellows 180*a* is positioned between the air inlet port 114 and the air inlet duct, as shown in FIGS. 4 and 5.

Figure 6A:
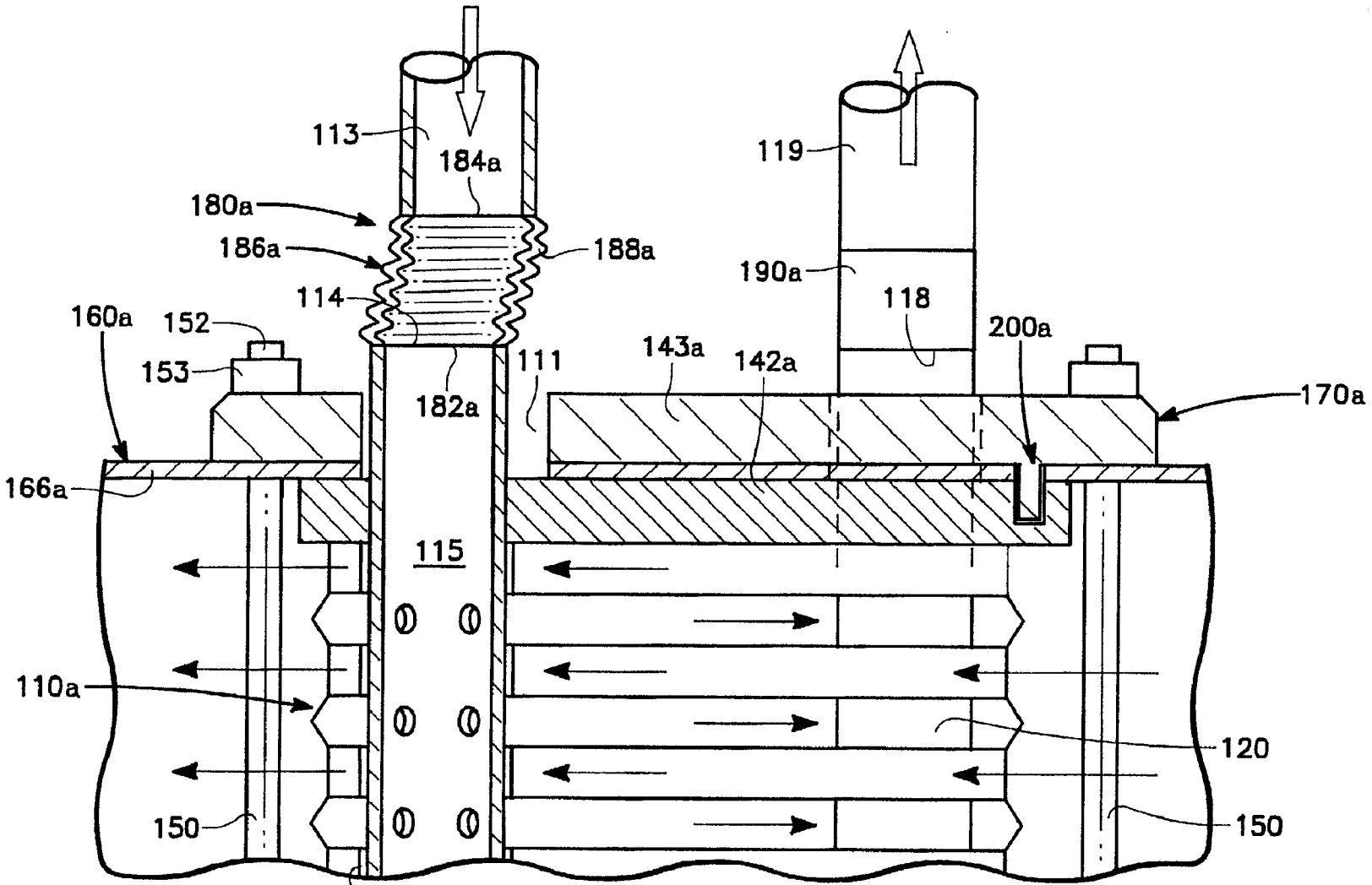
FIGS. 6*a* and *b* are perspective views of cross-sections of a portion of a heat exchanger in accordance with the present invention.

As shown in FIGS. 6*a* and *b* (FIGS. 6*a* and *b*), the inlet bellows 180*a* includes a lower portion 182*a*, an upper portion 184*a* and side walls 186*a*. The lower portion 182*a* is mounted to the core 110*a* at the air inlet port 114. The upper portion 184*a* is mounted to the external air inlet duct. The side walls 186*a* are deformable both laterally and along the length of the bellows 180*a*. The side walls 186*a* include alternating planar sections 188*a*.

The inlet bellows 180*a* can be any of a variety of materials including steel and aluminum, however it is preferred that stainless steel is used. In place of a bellows a flexible high temperature hose or a braided (e.g. woven) metal hose can be used.

The bellows 180*a* can be any of a variety of shapes and dimensions, however, it is preferred that the bellows 180*a* have a round shape to match that of the preferred tube shapes of the air inlet port 114 and air inlet tube. The length of the bellows 180*a* can vary, but is preferably dependent on the maximum differential expansion and/or contraction of the core 110*a*. The greater the overall difference between the lateral dimensions of the core 110*a* and the support structure 170*a*, the greater length of the bellows 180*a* will be.

As the core 110*a* expands or contracts, the inlet manifold 116 moves laterally to one side or the other, relative to the support structure 170*a*, as shown in FIGS. 6*a* and *b*. As the inlet manifold 116 moves laterally, it carries along with it the inlet manifold tube 115. The inlet bellows 180*a* deforms laterally to allow air to flow from the air inlet duct through the bellows 180*a* and into the inlet manifold tube 115 (via the air inlet port 114). FIG. 6*a* shows the core 110*a* having differentially expanded laterally away from the mount 200*a* faster than the lateral expansion of the support structure 170*a*. As a result, the bellows 180*a* has shifted its lower portion 182*a* to the left with the inlet manifold tube 115. The inlet manifold tube 115 moves within an expansion opening 111 formed in the upper strong back 143*a*. The expansion opening 111 is sized and shaped to allows the inlet manifold tube 115 to move without contact with the upper strong back 143*a*. The specific size of the expansion opening 111 can vary and is dependent on the maximum amount of differential expansion and contraction of the core 110*a*.

Figure 6B:
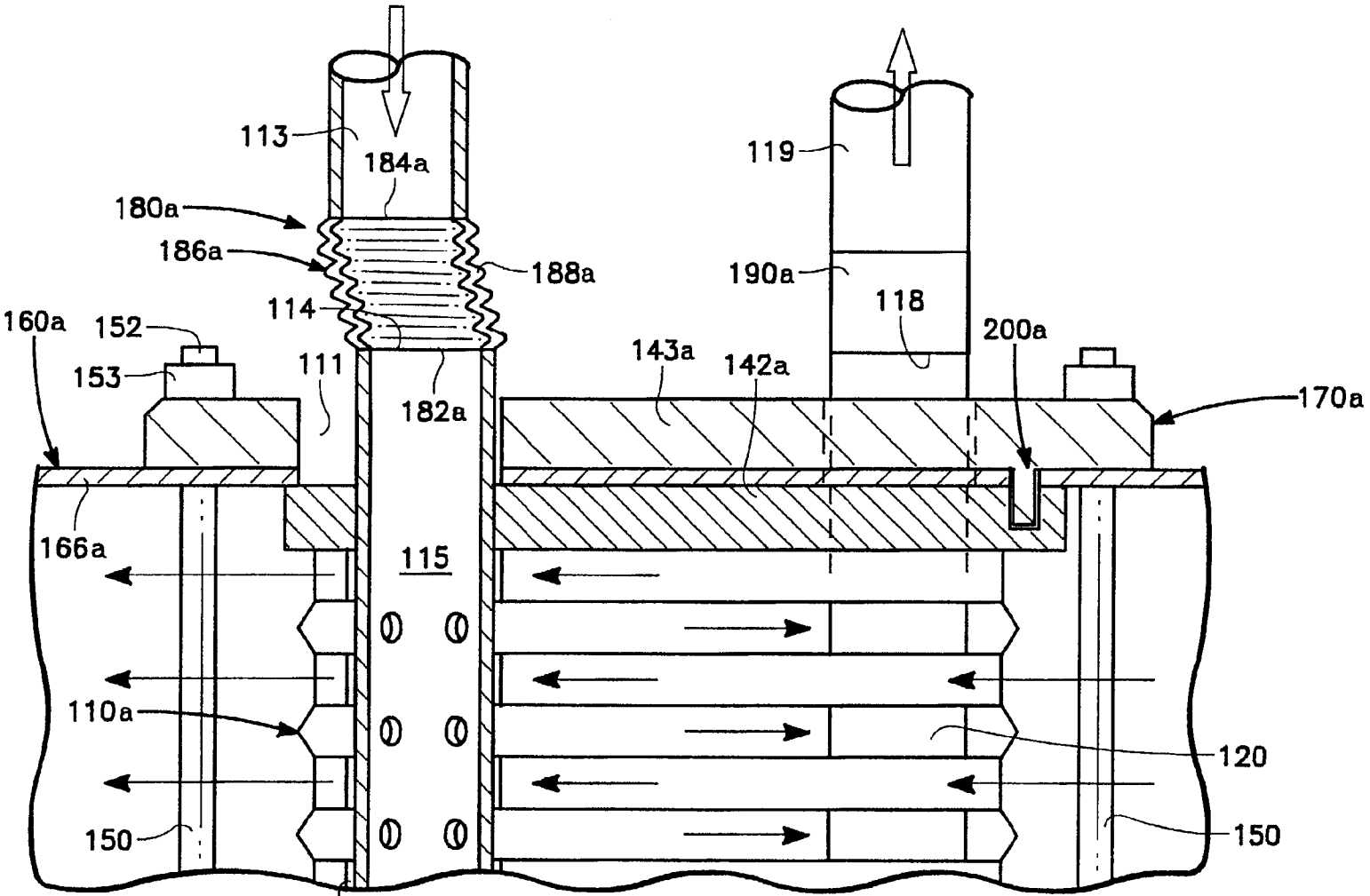

In contrast, FIG. 6*b* shows the core 110*a* having contracted towards the mount 200*a* quicker than the support structure 170*a*. In so doing, the bellows 180*a* has had its lower portion 182*a* shifted to the right relative to the upper portion 184*a*. The inlet manifold tube 115 has moved to the right in the expansion opening 111.

In either the case of the differential expansion or contraction of core 110*a*, the inlet bellows 180*a* maintains a seal with the inlet manifold tube 115 and with air inlet duct. As can be seen, with either the core's expansion or contraction, the bellows 180*a* maintains a clear pathway for the passage of air into the core 110*a*.

As can be seen in FIGS. 4 and 5, the mount 200*a* is positioned between the core 110*a* and the support structure 170*a*. It is preferred that the mount 200*a* is positioned near the air outlet port 118, such that any movement of the core 110*a* relative to the support structure 170*a* at the connector 190*a* is minimized. This eliminates the need for a separate bellows to be used between the air outlet port 118 and the air outlet duct, resulting in a reduction of the overall cost and complexity of the heat exchanger 100.

Of course, the mount 200*a* can be positioned at any of a variety of locations about the connector 190*a* other than that shown in FIGS. 4 and 5. While it is preferred that the mount 200*a* is kept relatively close to the connector 190*a*, depending on the specific amount of maximum differential expansion and contraction, the position of mount 200*a* relative to the connector 190*a* can vary. That is, generally the less the differential expansion and contraction, the further the mount 200*a* can be positioned laterally away from the connector 190*a* without overly deforming the connector 190*a* or damaging it.

Figure 7:
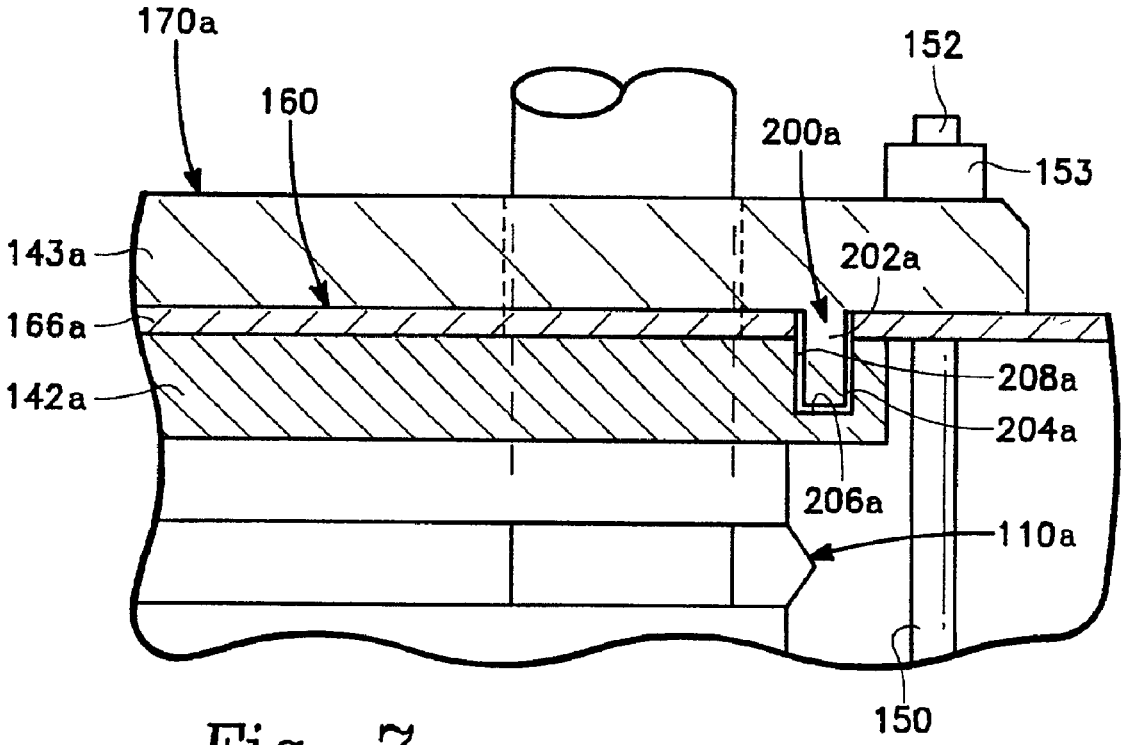
FIG. 7 is a perspective view of a cross-section of a portion of a heat exchanger in accordance with the present invention.

As shown in FIG. 7 (FIG. 7), the mount 200*a* includes the pin 202*a* and a receiver, mating relief or recess 206*a*. In at least one embodiment, the pin 202*a* is attached to the upper strongback 143*a* of the support structure 170*a* and extends towards the core 110*a*. The pin 202*a* includes sides 204*a*. The pin is received in a receiver 206*a*, which in this embodiment, is a hole defined in the first end plate 142*a*. The receiver 206*a* includes sides 208*a*.

FIGS. 6*a* and *b* and 7 show that the pin 202*a* is positioned in the receiver 206*a*, such that the pin 202*a* restrains movement of the core 110*a* relative to the support structure 170*a* at the mount 200*a*. As the core 110*a* begins to displace laterally, the sides 204*a* of the pin 202*a* contact the sides 208*a* of the receiver 206*a* to prevent the core 110*a* from moving. However, since the remainder of the core 110*a* can move laterally substantially freely (with the first end plate 142*a* moving adjacent to the upper panel 166*a* of the shell 160), the core 110*a* will expand out from the mount 200*a* and contract towards it. As such, the expansion and/or contraction at the connector 190*a* will be much less than that at the bellows 180*a*.

The pin 202*a* can be any of a variety of materials including steel and aluminum but it is preferred that stainless steel is used. The pin 202*a* preferably has a cylindrical shape, of course other shapes are possible as well.

The pin 202*a* is secured to the upper strongback 143*a* and for additional strength can also be secured to the shell 160*a*. In some embodiments, the pin 202*a* is attached to the shell 160*a* and/or the upper strongback 143*a* by welding, brazing, adhesives or any similar method. In other embodiments, the pin 202*a* can be a formed part of either the strongback 143*a* (as shown in FIGS. 4–7) or the shell 160*a*. In at least some embodiments the pin 202*a* is a tab which is bent, or otherwise deformed, from the shell 160*a* and/or the upper strongback 143*a*.

The dimensions of the pin 202*a* are variable, depending on the specific use in which it is employed and material used. The dimensions of the pin can be determined by one skilled in the art using well known analytical and/or empirical methods.

The receiver 206*a* can be created by forming, drilling and/or any other similar well known method. The receiver 206*a* is sized to closely receive the pin 202*a*. This prevents lateral movement of the core 110*a* at the mount 200*a*.

The mount 200*a*, including the pin 202*a* and the receiver 206*a* must be strong enough to carry the loads generated by the differential thermal expansion and/or contraction of the core 110*a*, without any significant damage to the mount 200*a*. The mount 200*a* needs to be able to carry such loads over repeated cycles of differential expansion and contraction of the core 110*a*.

Certain embodiments of the present invention use more than one mount 200*a* to secure the core 110*a*. It is preferred that such embodiments have the mounts 200*a* positioned close enough to each other to prevent damage from differential expansion and/or contraction of the core 110*a*. In certain embodiments the multiple mounts 200*a* are positioned about the outlet manifold 120 so as to minimize or prevent lateral movement of the core 110*a* at the connector 190*a*.

In some embodiments of the present invention, the mount has a reverse arrangement.

Figure 8:
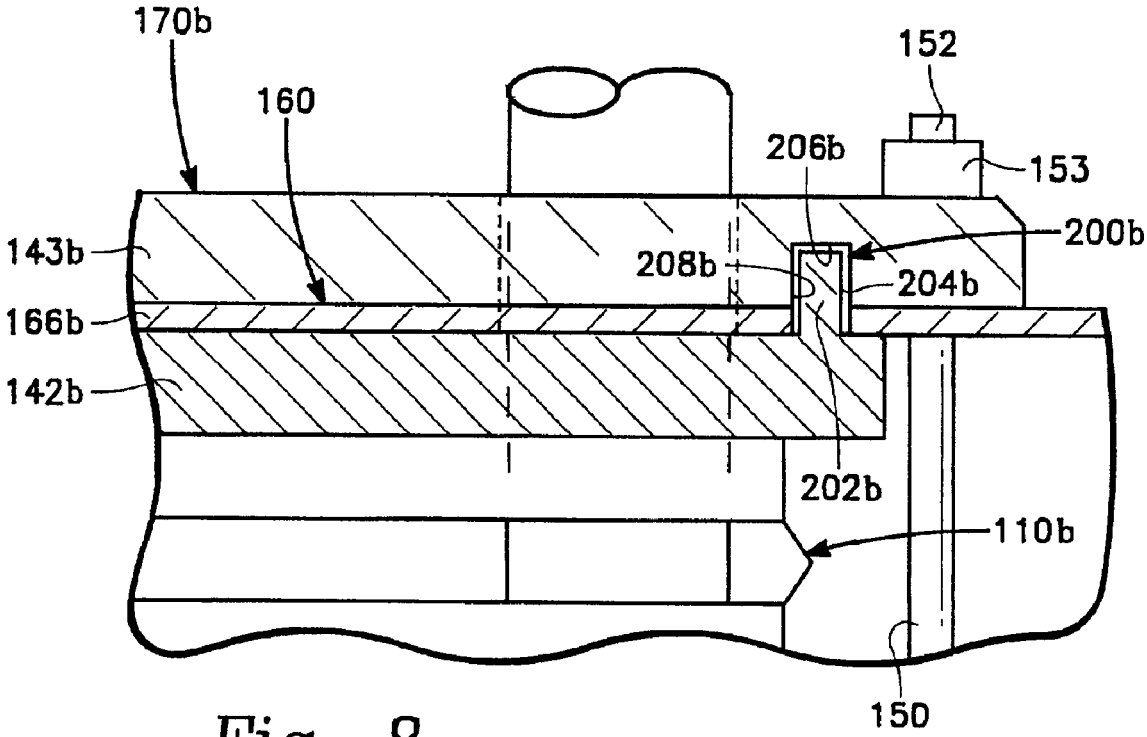
FIG. 8 is a perspective view of a cross-section of a portion of a heat exchanger in accordance with the present invention.

As shown, in FIG. 8 (FIG. 8), a mount 200*b* has a pin 202*b* which is attached to the core 110*b* and which extends into a receiver 206*b* positioned in the support structure 170*b*. The pin 202*b* is secured to first end plate 142*b*. The pin 202*b* can be a formed part of the first end plate 142*b* (as shown) or it can be attached thereto by welding, brazing, adhesives or any similar method. In other embodiments the pin 202*b* is a tab which is material bent out from the first end plate 142*b*. The receiver 206*b* is defined out of the upper panel 166*b* of the shell 160*b* and/or out of the upper strongback 143*b*. The receiver 206*b* can be created by forming, drilling and/or any other similar well known method.

Figure 9:
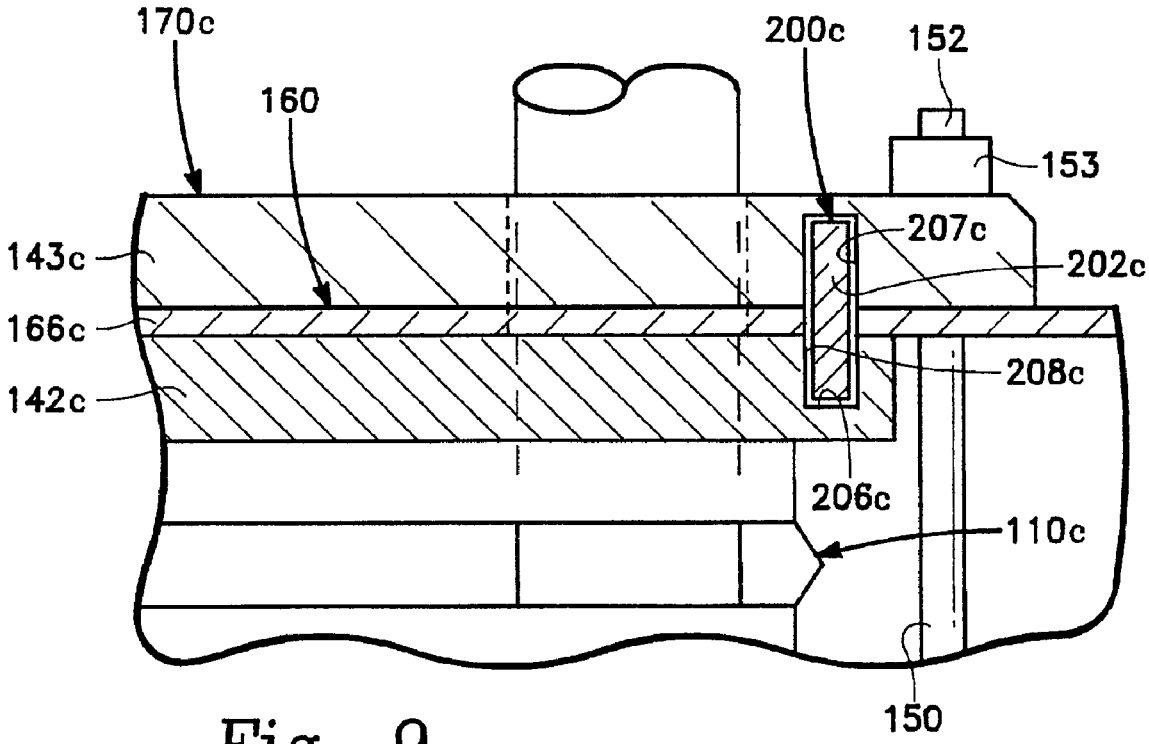
FIG. 9 is a perspective view of a cross-section of a portion of a heat exchanger in accordance with the present invention.

In other embodiments, a mount 200*c* includes a pin 202*c*, a core receiver 206*c* and a support structure receiver 207*c*, as shown in FIG. 9 (FIG. 9). The pin 202*c* is received by both the core receiver 206*c* and the support structure receiver 207*c*. In this manner, the core 110*c* is held in place by the pin 202*c* being held laterally by both the receiver 206*c* and the receiver 207*c*. In these embodiments the core receiver 206*c* and the support structure receiver 207*c* are defined by forming, drilling or the like.

Figure 10:
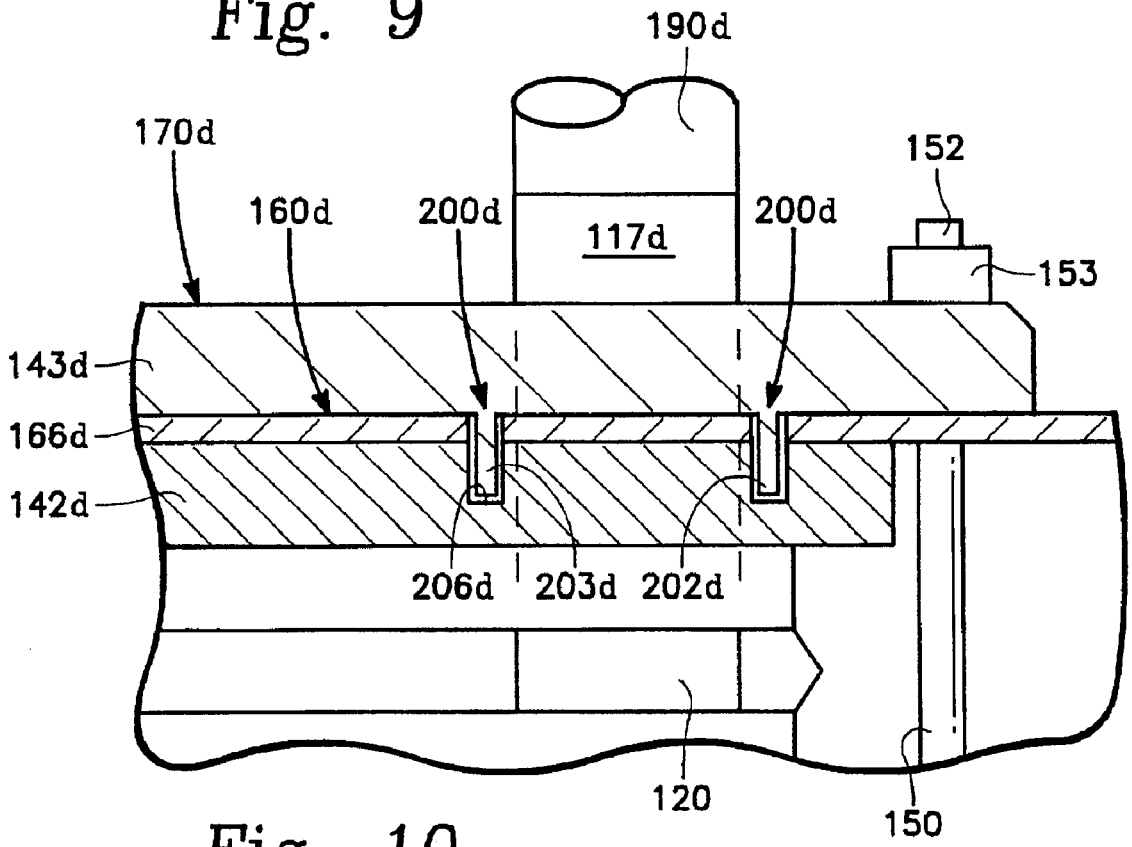
FIG. 10 is a perspective view of a cross-section of a portion of a heat exchanger in accordance with the present invention.

As shown in FIG. 10 (FIG. 10), in another embodiment of the present invention, a mount 200*d* is positioned about the outlet manifold 120. In this embodiment the mount includes a ring 203*d* and a receiver 206*d*. The ring 203*d* is attached to the support structure 170*d* about the manifold tube 117*d* and extends into the receiver 206*d*. The receiver 206*d* is defined in the core 110*d* about the outlet manifold 120. The mount 200*d* allows the core to laterally expand about the outlet manifold 120 while preventing lateral movement at the outlet manifold 120. This provides the benefit that the connector 190*d* is not deformed during the differential expansion and contraction of the core 110*d*. This embodiment continues to use a bellows (not shown) between the air inlet (not shown) and the inlet manifold tube (not shown). As with other embodiments of the present invention (as detailed above), the mount 200*d* can have a variety of embodiments. The mount 200*d* can have a ring mounted to the core 110*d* and a receiver defined in the supporting structure 170*d*, or both the core 110*d* and the support structure 170*d* can have a receiver, which has each receiver accepting a portion of a ring set therebetween. Also, the mount 200*d* can be a set of pins and receivers positioned about the outlet manifold 120. In some embodiments of the present invention, the ring 203*d* and the connector 190*d* are attached or formed as a single structural element.

Figure 11:
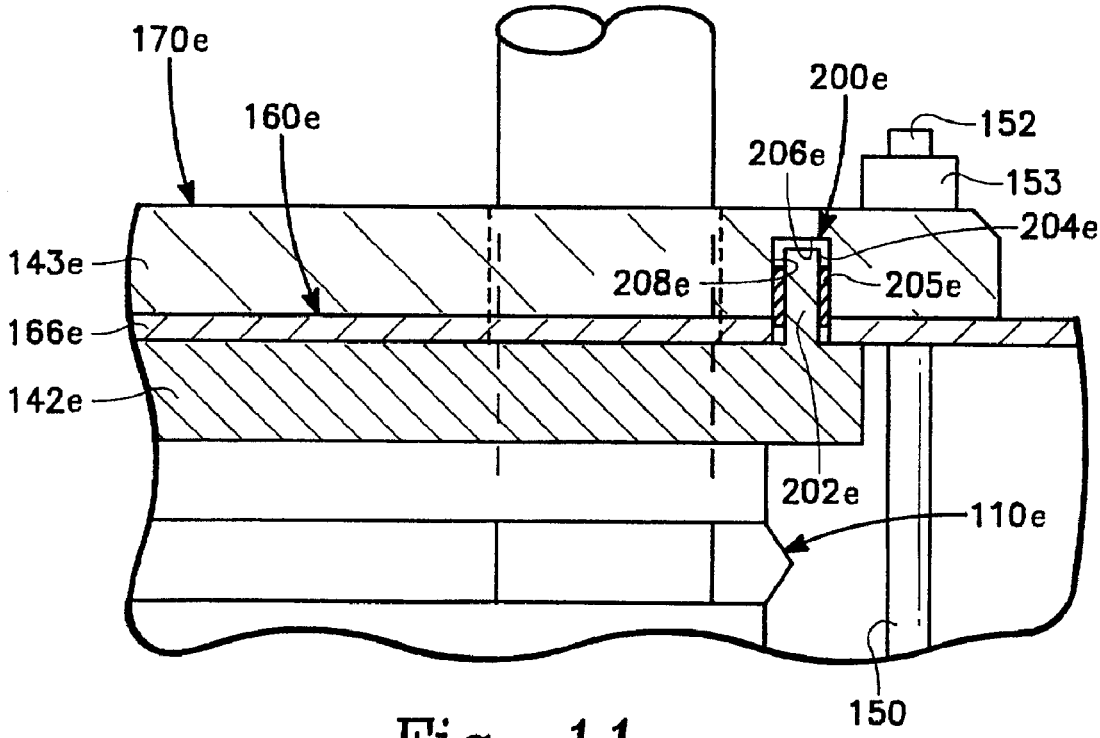
FIG. 11 is a perspective view of a cross-section of a portion of a heat exchanger in accordance with the present invention.

In still other embodiments of the present invention, the core 110*e* and the support structure 170*e* are attached in a fixed manner to one another. As shown in FIG. 11 (FIG. 11), a mount 200*e* includes a pin or tab 202*e* extending from the first end plate 142*e* to the support structure 170*e*. The pin 202*e* is secured to the shell 160*e* and the upper strongback 143*e*. The pin 202*e* can be secured by any of a variety of methods including by welding, brazing, the use of adhesives, or the like. The weld, brazing or adhesive 205*e* secures the pin 202*e* to the shell 160*e* and the upper strongback 143*e*. The pin 202*e* can be formed from the first end plate 142*e* (as shown) or otherwise affixed thereto. In other embodiments the pin 202*e* can extend from the support structure 170*e* and be welded, brazed or otherwise adhered to the core 110*e*. The pin 202*e* can also be set between the support structure 170*e* and the core 110*e* and welded, brazed or otherwise adhered to both the support structure 170*e* and the core 110*e*.

Figure 12:
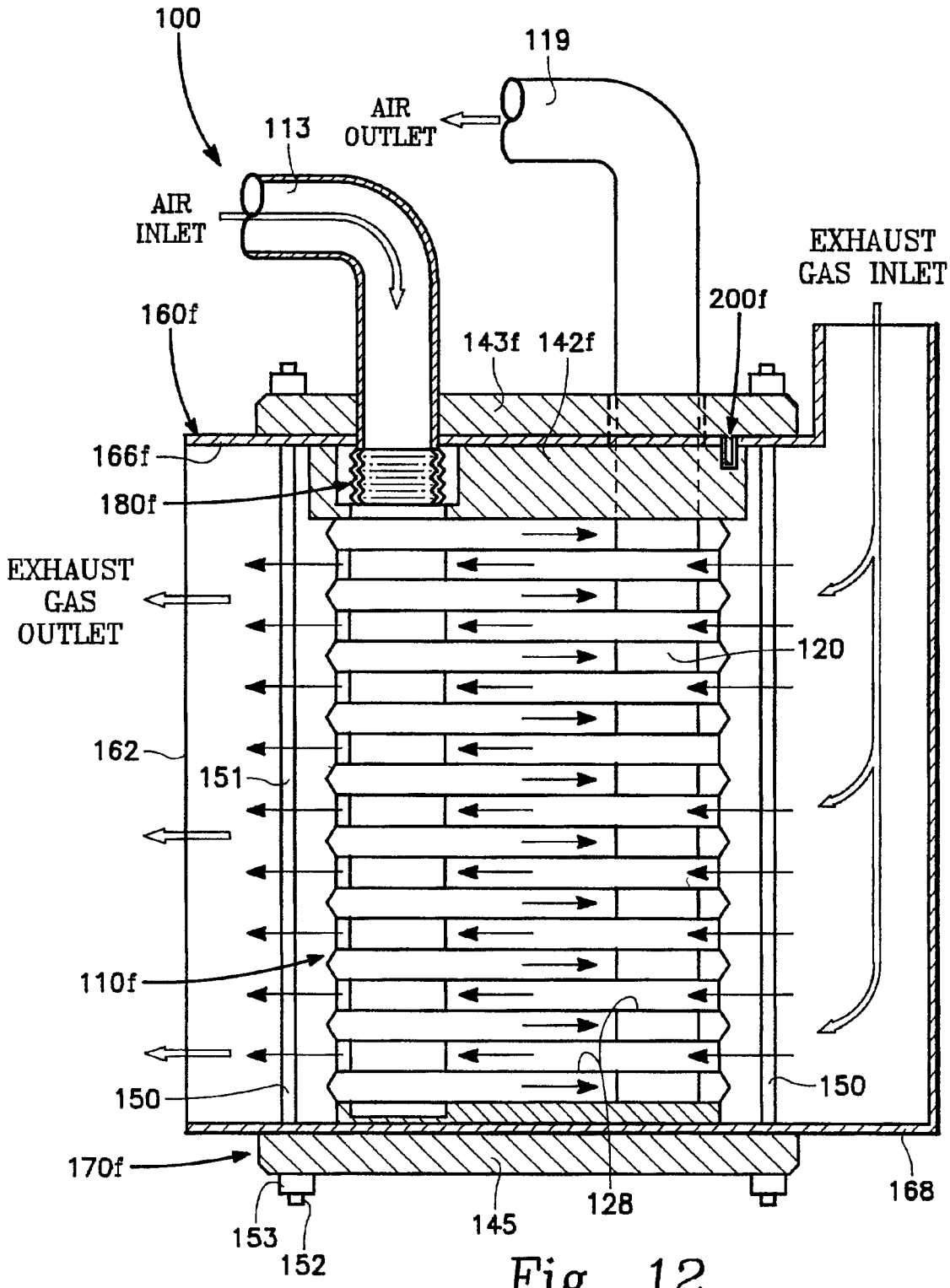
FIG. 12 is a perspective view of a cross-section of a portion of a heat exchanger in accordance with the present invention.

In some embodiments of the present invention a bellows 180*f* is positioned between the core 110*f* and the support structure 170*f*, as shown in FIG. 12 (FIG. 12). In this position as the core 110*f* expands away from and contracts towards the mount 200*f*, the bellows 180*f* maintains a substantially unobstructed fluid pathway between the air inlet and the core 110*f*. The first end plate 142*f* is position away from the bellows 180*f* (about the bellows) to provide space for the bellows 180*f* as the first end plate 142*f* moves with the expansion and contraction of the core 110*f*. In this embodiment, both the upper strongback 143*f* and the upper panel 166*f* of the shell 160*f* can be position adjacent or in contact with the inlet duct as the inlet duct does not move relative to them. Although not shown, a manifold tube can be positioned in the inlet manifold 116 and attached to the lower portion of the bellows 180*f*.

In other embodiments of the present invention a higher temperature fluid enters the core at the inlet, is cooled in the core and exits at the outlet at a lower temperature. Also, a separate lower temperature fluid enters the inlet of the shell, is heated as it passes through the core and exits the shell at the outlet at a higher temperature. In such embodiments the core functions to reduce the temperature of the fluid passing through it. In these embodiments the mount (e.g. mounts 200*a–f*) is positioned adjacent the input to the core and the flexible connector (e.g. bellows 180*a–f*) is positioned at the output of the core. In this manner, the core has a minimum amount (if any) of differential expansion or contraction near the higher temperature fluid port of the core. This eliminates the need for an expensive and complex flexible connector to be employed at the higher temperature fluid port to carry the high temperature fluid. Also, with the flexible connector positioned at the lower temperature fluid port of the core, the flexible connector can be constructed to carry lower temperature fluid. This reduces the cost and complexity of the heat exchanger.

While the preferred embodiments of the present invention have been described in detail above, many changes to these embodiments may be made without departing from the true scope and teachings of the present invention. The present invention, therefore, is limited only as claimed below and the equivalents thereof.

What is claimed is:

1. A recuperator comprising:

a. a laterally thermally expandable core having a variable size, a core inlet and a core outlet;

b. a support structure having a shell with opposing ends, an upper strongback, a lower strongback, a set of tie rods, wherein the core is received in the shell, wherein the upper strongback and lower strongback are positioned on the opposing ends of the shell, wherein the upper strongback and the lower strongback are connected with the set of tie rods;

c. a mount positioned between the core and the support structure adjacent the outlet of the core, wherein the mount comprises a pin and a receiver, wherein the pin is attached to the support structure and wherein the receiver is defined in the core, wherein the receiver receives the pin to restrain the core, wherein the mount restrains the core such that the core varies in size laterally away from and towards the mount; and d. a deformable connector attached to the core inlet such that the deformable connector and the core inlet are in fluid communication as the core varies in size.

2. The recuperator of claim 1, wherein the core inlet is a lower temperature fluid inlet and the core outlet is a higher temperature fluid outlet.

3. The recuperator of claim 1, wherein the deformable connector is selected from the group of a bellows, a flexible hose, and a braided metal hose.

4. The recuperator of claim 1, wherein the pin is attached to the support structure by one from the group of a weld, a brazing and an adhesive.

5. The recuperator of claim 1, further comprising a substantially rigid connector positioned such that the deformable connector and the core outlet are in fluid communication.

* * * * *